US005497164A

United States Patent [19]

Croq

[11] Patent Number: 5,497,164

[45] Date of Patent: Mar. 5, 1996

[54] MULTILAYER RADIATING STRUCTURE OF VARIABLE DIRECTIVITY

[75] Inventor: Frédérice Croq, Toulouse, France

[73] Assignee: Alcatel N.V., Amsterdam, Netherlands

[21] Appl. No.: 252,210

[22] Filed: Jun. 1, 1994

[30] Foreign Application Priority Data

Jun. 3, 1993 [FR] France ..... 93 06660

[51] Int. Cl.[6] ..... H01Q 1/38

[52] U.S. Cl. ..... 343/700 MS; 343/846

[58] Field of Search ..... 343/700 MS, 829, 343/846, 848, 830; H01Q 1/38

[56] References Cited

U.S. PATENT DOCUMENTS 5,005,019 4/1991 Zaghloul et al. ..... 343/700 MS

FOREIGN PATENT DOCUMENTS

0279050A1 8/1988 European Pat. Off. .
0403910A1 12/1990 European Pat. Off. .
2046530 11/1980 United Kingdom ..... 343/700 MS
WO9101577 2/1991 WIPO .

OTHER PUBLICATIONS

Lee et al, "Microstrip Subarray With Coplanar and Stacked Parasitic Elements", *Electronics Letters,* vol. 26, No. 10, 10 May 1990, pp. 668–669.

Revankar et al, "Broadband Stacked Three-Layer Circular Microstrip Antenna Arrays", *Electronics Letters.* vol. 28, No. 21, Oct. 8, 1992, pp. 1995–1997.

*Primary Examiner*—Donald T. Hajec
*Assistant Examiner*—Hoanganh Le
*Attorney, Agent, or Firm*—Sughrue, Mion, Zinn, Macpeak & Seas

[57] ABSTRACT

The invention relates to antennas, and more particularly to plane or shaped array antennas. The antenna of the invention comprises radiating sources having a multilayer dielectric/conductor structure and a multiplicity of coupled elements distributed over the interfaces between successive dielectric layers, all being fed by a single radiating patch situated at the bottom level of the antenna. The geometrical parameters of the conductive patches and their distribution within the successive layers giving rise to a high degree of flexibility in antenna design, in particular with respect to simultaneously optimizing antenna parameters such as: directivity, bandwidth, efficiency, polarization purity, and symmetry of the radiation pattern. These advantages of the invention stem mainly from the possibility of increasing the radiating aperture of a source without increasing the complexity of passive distributors for distributing the radiated signals. This is obtained by coupling elements together between levels, and by devising shapes that enable the equivalent radiating area to be increased at each successive level.

12 Claims, 6 Drawing Sheets

MULTILAYER RADIATING STRUCTURE OF VARIABLE DIRECTIVITY

FIELD OF THE INVENTION

The field of the invention is that of array antennas, and more specifically that of multilayer and multi-element array antennas which are printed, with the radiating elements being implemented by the microstrip technique. Such antennas are made by etching or lithographically producing conductive tracks and patches on dielectric substrates which are generally, but not exclusively, planar. More elaborate configurations exist having a plurality of dielectric substrates, ground planes, resonant cavities, etc., several examples of which are described in greater detail below. In the present case, a plurality of dielectric layers are stacked together, each layer having a pattern of conductive tracks and/or patches.

BACKGROUND OF THE INVENTION

Such plane or thin antennas have been in widespread use in numerous forms over the last 15 years or so. They have indeed become the norm in many fields, given their intrinsic qualities: low mass, volume, and manufacturing costs.

It is well known to the person skilled in the art that the simplest way of making radiating elements, i.e. microstrip tracks etched on a substrate, suffer from fundamental theoretical limitations, in particular with respect to bandwidth, directivity, and quality of radiation. The radiation is firstly highly asymmetrical in different section planes for an element that operates with linear polarization, and secondly it suffers from levels of cross-polarization that are often incompatible with the specifications of space missions.

From French patent application No. 93 03502 (corresponding to pending U.S. patent application Ser. No. 08/214,425) in the name of the Applicant, a multi-element system is known that enables the directivity of a printed antenna to be increased by using a sub-array made up of a multiplicity of elements that are mutually coupled electro-magnetically, and that are distributed over a surface that is plane or shaped.

It is also known from French application No. 89 11829 of Sep. 11, 1989 (corresponding to pending U.S. patent application Ser. No. 07/882,760) and in the name of the Applicant, to use metal cavities to increase the bandwidth of a printed radiating element. That configuration also makes it possible to control radiation and inter-element coupling in an array made up of such elements.

Compared with conventional solutions such as horns or dipoles, solutions that make use of printed elements have the advantages of lower weight and bulk, however they also have lower performance with respect to various parameters of antenna operation. In particular, it turns out to be difficult to obtain simultaneously acceptable bandwidth with determined directivity and polarization purity compatible with telecommunications applications.

At present, printed radiating elements have directivities that lie conventionally in the range about 5 dBi to about 10 dBi as a function of the geometrical characteristics of the antenna (thickness of substrate, dimensions of radiating patches and of cavities if any) and of the materials used (dielectric constant of the substrates).

These directivity values are also intrinsically related to the resonant dimensions (about half the wavelength of the guided wave) of that type of radiating element which limit their radiating areas and consequently the maximum directivity that is accessible.

The conventional solution for obtaining greater directivity from a printed antenna is to put the radiating elements in an array. That generally leads to designing a feeder network for generating the feed relationships that are necessary for forming the desired radiation characteristics. Such feeder systems are necessary in particular for apodization of the relationship whereby the radiating aperture is fed, thus making it possible to avoid the appearance of secondary lobes, which are often undesirable in antenna systems for radar or for telecommunications.

The design of such feeder systems presents a certain number of problems, which are described in greater detail in French application No. 93 03502. Of those problems, the following may be mentioned briefly:

1) The complexity of such a system increases with the number of elements to be fed; complexity is even greater for an antenna operating with circular polarization.

2) The discontinuity or discretization of the apodization, due to the radiating area being sampled by discrete elementary radiating elements.

3) Coupling between the elements is difficult to take into account, and it is generally considered as being a phenomenon that tends to degrade the performance of the antenna.

4) Connections are complex, thereby tending to reduce the reliability of the antenna.

5) Losses in the energy distributor may be considerable, thereby hindering the use of such a solution at very high frequencies or for passive antennas having several tens of elements, since resistive losses become unacceptable under such circumstances.

Those problems are known to the person skilled in the art, numerous attempts have been made to ameliorate them, and they constitute the subject matter of many publications, with full treatment being given in "Handbook of Microstrip Antennas" by J. R. James, P. S. Hall, and C. Wood, appearing in IEE Electromagnetic Waves Series, No. 12, published by P. Perigrinus Ltd., Stevanage, UK. That publication forms an integral part of the present application for its description of the prior art.

However, the solutions proposed in the prior art imply making compromises, since other performance criteria of the antenna are limited as a counterpart to improvements in directivity. For example, the article by R. Q. Lee, R. Acosta, and K. F. Lee: "Radiation characteristics of microstrip arrays with parasitic elements" published in Electronics Letters, Vol. 23, pp. 835–837 (1987) describes a device that gives 11 dBi of directivity, but with a bandwidth of less than 1%, a total substrate thickness that is very high being of the order of 0.4 $\lambda$, and all that without any control of polarization or of symmetry in the radiation pattern.

Two other solutions propose enlarging the radiating area to improve directivity, either by coupling radiating elements in the same plane as the exciting patch, or else by fragmenting the upper resonating patch in a structure that has two superposed patches. The first solution is described by R. Q. Lee and K. F. Lee in "Experimental study of the two-layer electromagnetically coupled rectangular patch antenna": IEEE Transactions on Antennas and Propagation (1990), Vol. AP-38, No. 8, pp. 1298–1302; while the second solution is described in French patent application No. 93 03502.

The directivity improvements presented by those known solutions nevertheless remain modest because of insufficient coupling in the first-mentioned case, and because of a radiating area that is still insufficient in the second solution.

OBJECTS AND SUMMARY OF THE INVENTION

An object of the invention is to mitigate the above limitations in the performance of prior art antennas, and in particular it seeks to provide simultaneously high gain, very wide bandwidth, control of polarization purity, and control of the radiation characteristics.

To this end, the present invention provides a radiating structure of variable directivity, said structure comprising a plurality of radiating elements and excitation means for electromagnetically exciting said radiating elements, wherein said radiating elements are distributed at the interfaces of a plurality of dielectric spacers stacked over successive levels in a multilayer radiating structure, said multilayer radiating structure being itself disposed on said excitation means.

In an advantageous embodiment, said multilayer radiating structure comprises a plurality of dielectric interfaces, each dielectric interface including one or more radiating elements, said structure being made up in such a manner that each successive interface includes a coupled radiating area that is greater than the area of the radiating elements of the preceding level, starting from a first level that contains said excitation means.

In a particularly advantageous variant, the radiating elements at different levels are coupled by electromagnetic coupling in such a manner as to avoid the need for a special structure for distributing electromagnetic energy.

In a preferred embodiment, the bottom level includes a single radiating patch which is excited by said excitation means and which in turn excites the radiating elements of the next level, and so on.

According to another characteristic, the first radiating patch which is on the first level of the multilayer structure is itself fed in such a manner as to radiate the desired polarization. The polarization of the exciting radiating patch is then controlled and improved during coupling with the various radiating structures on the higher levels by using structures and radiating elements of appropriate shapes.

According to another preferred characteristic, the radiating elements of a higher level partially overlie the radiating elements of an immediately lower level when seen in projection in the stacking direction of the levels, and coupling between elements in contiguous levels is governed by the percentage overlap of said elements in the magnetic current zones, and also by the thicknesses and the dielectric qualities of the separators.

In a preferred embodiment, particular polarization can be obtained by the use of excitation by sequential rotation in a coupled structure. In a variant, the radiating structure may be fitted with a polarizing grid.

BRIEF DESCRIPTION OF THE DRAWINGS

The principles of the invention and various embodiments and advantages acquired by using the invention are given in greater detail by the following description other with the accompanying drawings, in which.

MORE DETAILED DESCRIPTION

In all of the figures, the same references are used to refer to the same elements, and the description of those elements is not repeated for each of the figures.

Figure 1:
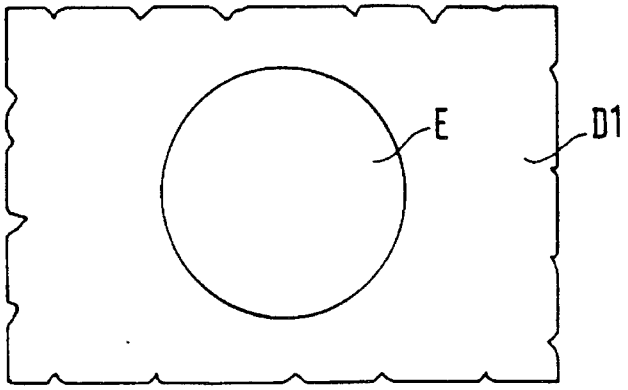
FIG. 1 PRIOR ART
FIG. 1 is a diagrammatic plan view of a prior art printed radiating element comprising an exciter first element E constituted by a conductive patch disposed on one face of a dielectric substrate D1 which is plane or shaped.
Figure 2:
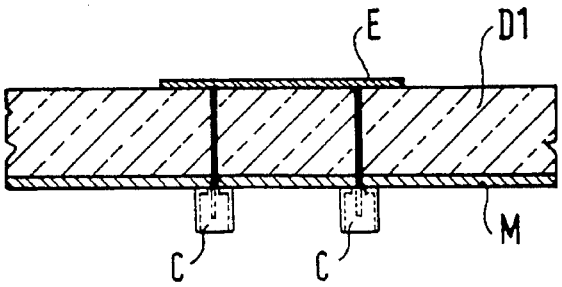
FIG. 2 PRIOR ART
FIG. 2 is a diagrammatic section view of the prior art printed radiating element of FIG. 1.

In FIGS. 1 and 2, there can be seen the simplest example of a prior art patch type radiating element shown respectively in plan and in section. The exciter element E is a patch of conductive material printed or etched on one face of a dielectric substrate D1. The other face of the dielectric is covered in a conductive layer M that acts as a ground plane. In the present example, the exciter patch E is fed via coaxial connectors C, however any other form of feed technology could be used instead, for example: strip line, microstrip, slot coupling, etc.

It should be mentioned at this point that all of the examples in FIGS. 1 to 12 are shown on plane substrates; nevertheless the invention and the devices of the prior art can all be adapted to shaped surfaces, and the examples shown should not be considered as being limiting in this respect.

Figure 3:
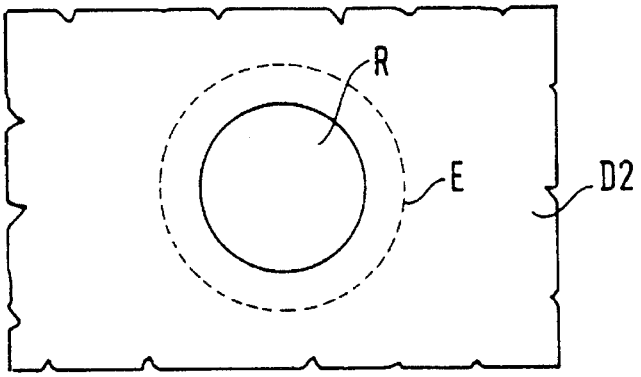
FIG. 3 PRIOR ART
FIG. 3 is a diagrammatic plan view of a prior art printed radiating element comprising an exciter patch first element E having the shape common to FIGS. 1 and 2, together with a resonator patch second element R disposed in front of the exciter first element E (in the radiating direction) on a second dielectric substrate D2.
Figure 4:
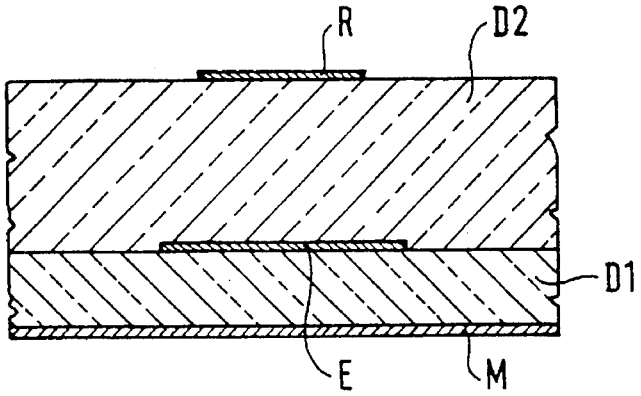
FIG. 4 PRIOR ART
FIG. 4 is a diagrammatic section view through an example of the radiating element of FIG. 3.

FIGS. 3 and 4 show a second example of a prior art printed radiating element comprising an exciter patch first element E disposed on a first dielectric substrate D1 having the same geometry as in FIGS. 1 and 2, together with a resonator patch second element R disposed on a second dielectric substrate D2 placed in front of the exciter first element E (in the radiating direction). For reasons of ease of manufacture and of mechanical stability, these substrates are contiguous in practical embodiments, and they are generally made of the same dielectric material.

In the example of FIGS. 3 and 4, the thickness H2 of the second dielectric substrate D2 is greater than the thickness H1 of the dielectric substrate D1 so as to form a resonant cavity between the exciter patch E and the resonator patch R at the operating frequency. This configuration makes it possible to govern coupling between the elements, and consequently the bandwidth of the device. The diameter of the resonator patch R is less than the diameter of the exciter patch E. These parameters can be manipulated to optimize gain and directivity, or bandwidth of the single element.

Figure 5:
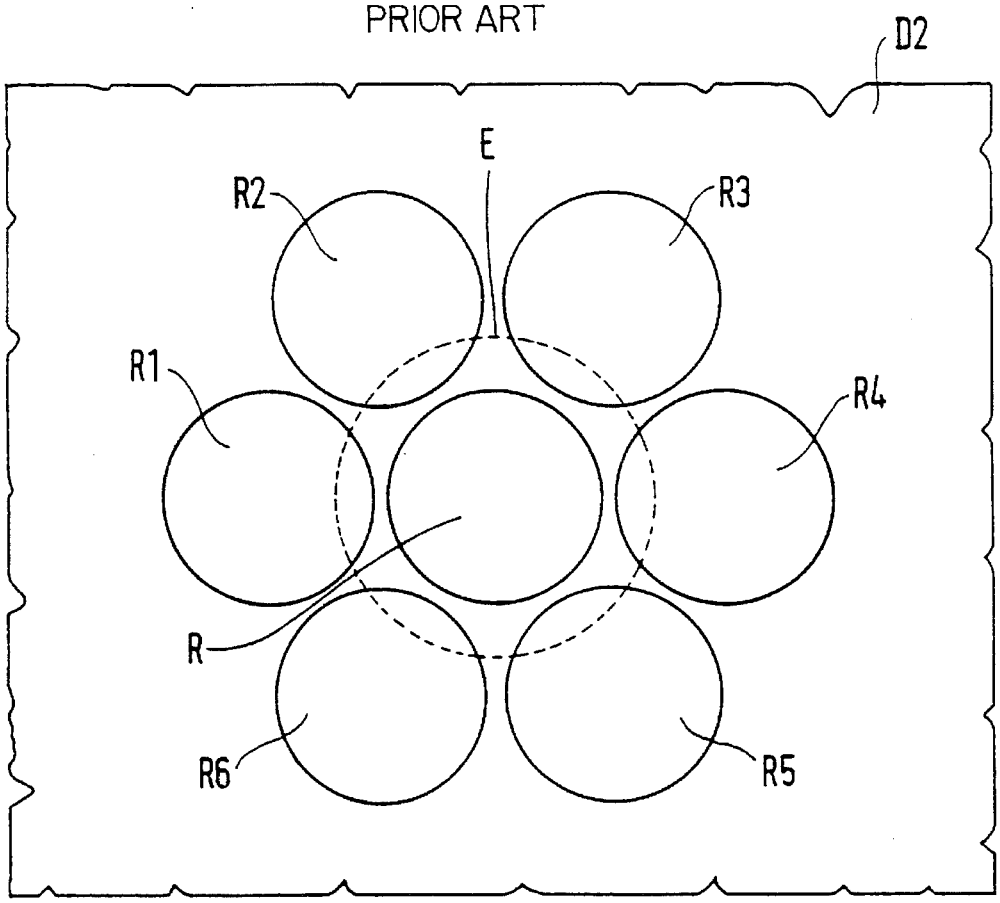
FIG. 5 PRIOR ART
FIG. 5 is a diagrammatic plan view of an example of a prior art printed radiating structure in which the resonating second element is of multi-element structure.
Figure 6:
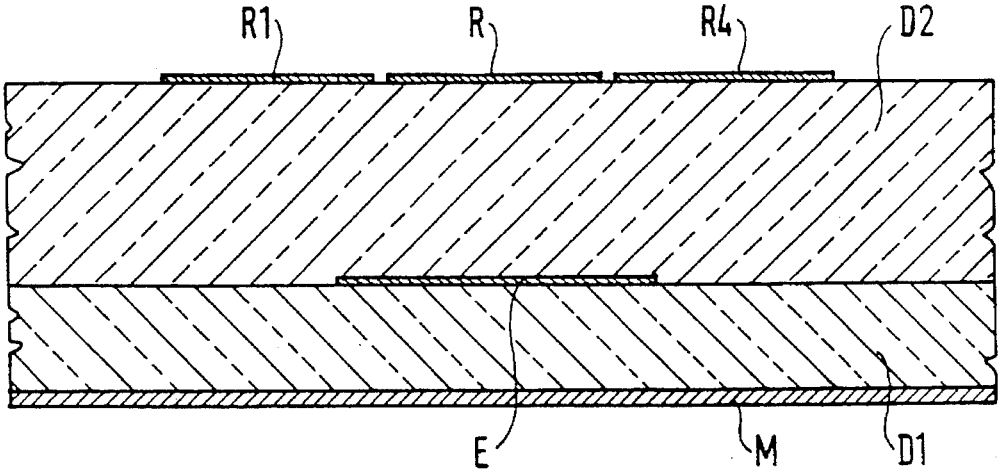
FIG. 6 PRIOR ART
FIG. 6 is a diagrammatic section view through the FIG. 5 example of a printed radiating structure.

In the example of FIGS. 5 and 6, there can be seen another simple embodiment of a prior art radiating structure. As in the example of FIGS. 3 and 4, there is an exciter patch E on one face of a first dielectric substrate D1, whose other face carries a conductive layer M constituting a ground plane.

As in the preceding figures, a resonator patch R is disposed on a second dielectric substrate D2 placed on the first substrate D1. The diameter of the resonator patch R is less than the diameter of the exciter patch E. In the example of FIGS. 5 and 6, the single resonator patch R is associated with a plurality of radiating elements (R1, . . . , R6, . . . ) distributed on an insulating surface (D2) that is stacked on said excitation means (C, E, M, D1) in a multilayer structure. The secondary resonator patches (R1, . . . , R6) are disposed around the central resonator patch R to form a multi-element resonator in such a manner as to overlie the exciter patch E in a current zone thereof, i.e. over its periphery.

The second insulating surface D2 thus includes a total area of resonator patch elements (R1, . . . , R6, R) that is considerably greater than the area of the exciter patch E on its own, or of the resonator patch R of FIG. 3. The effective aperture of the antenna is increased in proportion, thereby providing a gain in directivity. An example of a device based on this principle is described in greater detail in French patent application No. 93 03502.

Figure 7:
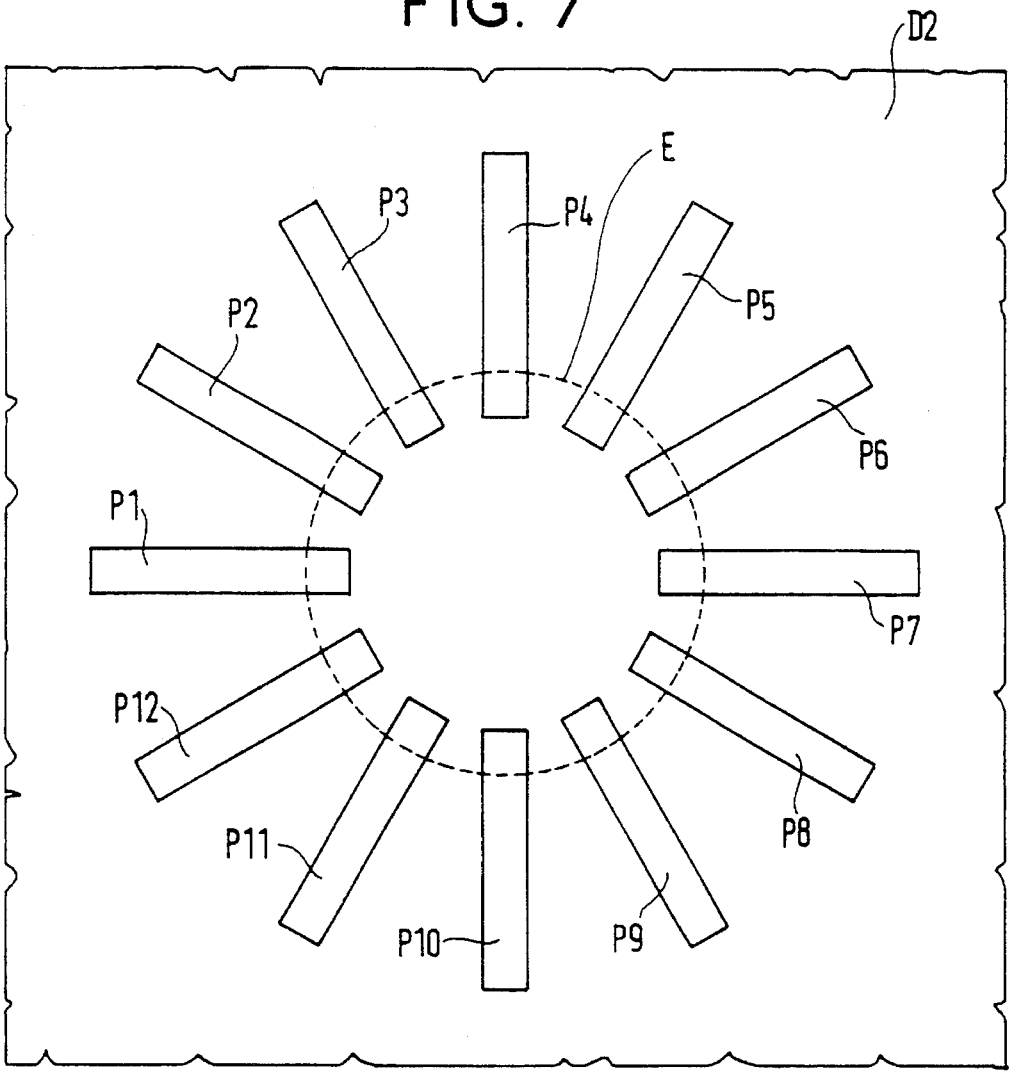
FIG. 7 is a diagrammatic plan view of another example of a printed radiating structure which consists in an exciter first patch E on a lower, first level and a polarization Grid made up of a multiplicity of patches disposed on a second level of dielectric D2 in a particular configuration.
Figure 8:
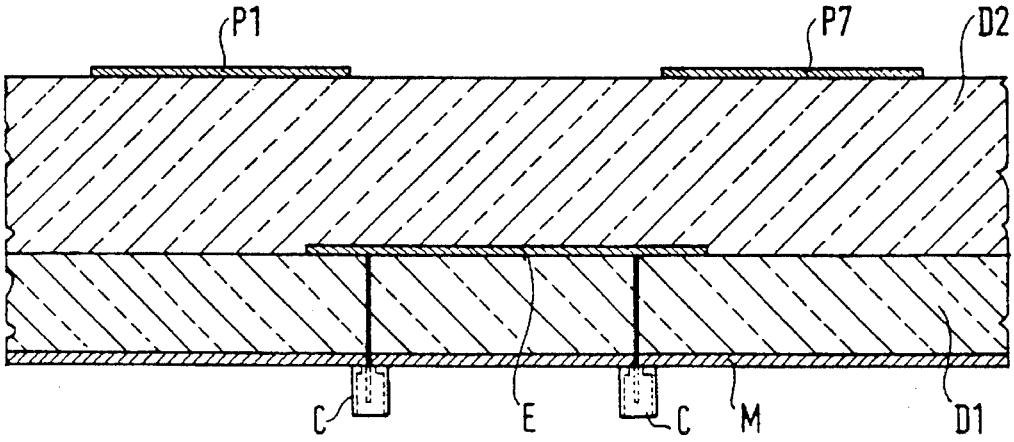
FIG. 8 is a diagrammatic section view through the FIG. 7 example of a printed radiating structure.

FIGS. 7 and 8 are a plan view and a section view respectively of an example of another embodiment of a radiating element in which a polarization grid is formed by the special geometry of the resonator patch elements (P1, . . . , P12) disposed in a star on the surface of a dielectric substrate D2 of thickness H2.

The disposition of FIG. 7 is particularly adapted to circularly polarized radiation. The excitation means (C) for the exciter patch E are fed so as to excite circular polarization in the first patch E which in turn excites the multi-element resonator (P1, . . . , P12) by electromagnetic coupling. The magnetic currents at the periphery of the exciter element E excite currents in the elements P1 to P12. Because circular polarization generates a rotating electric field vector, a colinear pair of elements (e.g. P1, P7) is excited preferentially at any given moment, depending on the orientation of the electric field at that moment, with smaller amplitude excitation being applied to the adjacent pairs (P12, P6; P2, P8) and no excitation being applied to the orthogonal pair (P4, P10, for example). A pair of dipoles excited with a phase shift of 180° (antiphase) serves to compensate for the 180° space phase shift between said elements. This enables co-polar components to sum constructively while anti-polar components sum destructively.

In this manner, the desired polarization is controlled and reinforced by the multi-element resonator (P1, . . . , P12) thus giving very high purity of polarization while simultaneously increased directivity because of the larger radiating aperture, together with optimized efficiency.

Figure 9:
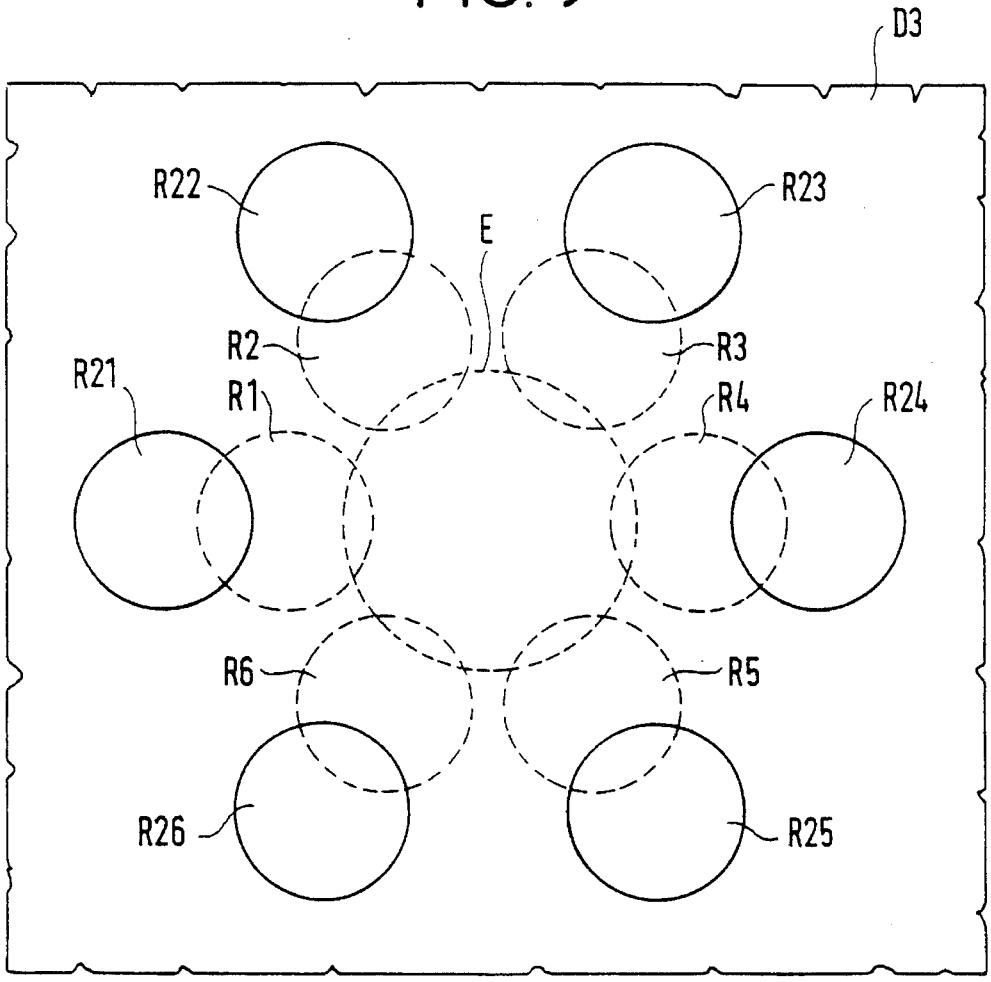
FIG. 9 is a diagrammatic plan view of an example of a printed radiating structure of the invention which consists in an exciter first patch E on a first dielectric substrate D1, and a resonator second element having a multi-element structure (R1, . . . , R6) disposed on a second dielectric substrate D2, and a multi-element resonator third element (R21, R22, . . . , R26) disposed on a third dielectric substrate D3 which is superposed on a configuration like that of FIG. 5.
Figure 10:
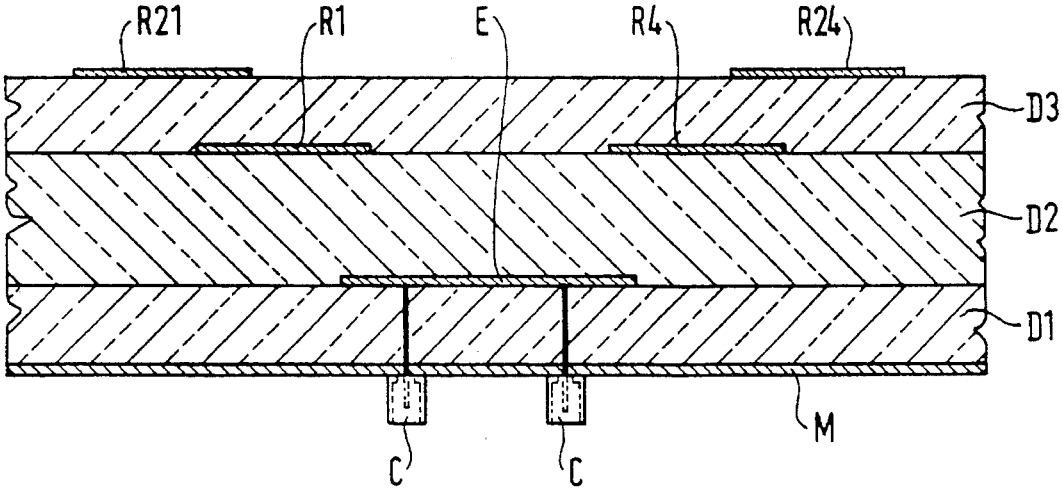
FIG. 10 is a diagrammatic section view through the FIG. 9 example of a printed radiating structure.

FIGS. 9 and 10 are a plan view and a section view respectively of an example of an embodiment of a printed radiating structure of the invention in which there are two upper levels each comprising a dielectric substrate (D2; D3) on which a multi-element resonator (R1, . . . , R6; R21, . . . , R26) is formed by lithography or by etching.

As in the preceding figures, an exciter first patch E on the top face of a first dielectric substrate D1 having a ground plane M on its opposite face is excited by excitation means which, in this example, comprise coaxial connectors C. Excitation of the element E generates magnetic currents at its periphery which, by electromagnetic coupling, in turn excite currents in the resonator elements R1, . . . , R6 of the adjacent level.

The excitation of these resonator elements on level D2 by the patch E generates magnetic currents at the periphery of each patch R1, . . . , R6, which in turn, by electromagnetic coupling, excite the resonator elements (R21, . . . , R26) of the next level of the radiating structure, which elements are disposed on the dielectric substrate D3.

The coupling between the elements of a level is the result of the Geometry of the various patches, and of the geometry of their relative disposition, as described in French application No. 93 03502 in the name of the Applicant. Coupling between elements of different levels is a function of the overlap between elements in adjacent levels (as can be seen in FIG. 9), and of the dielectric thickness (H1, H2) between elements, and also on the dielectric constant of each substrate (D1, D2, D3, . . . ).

Figure 11:
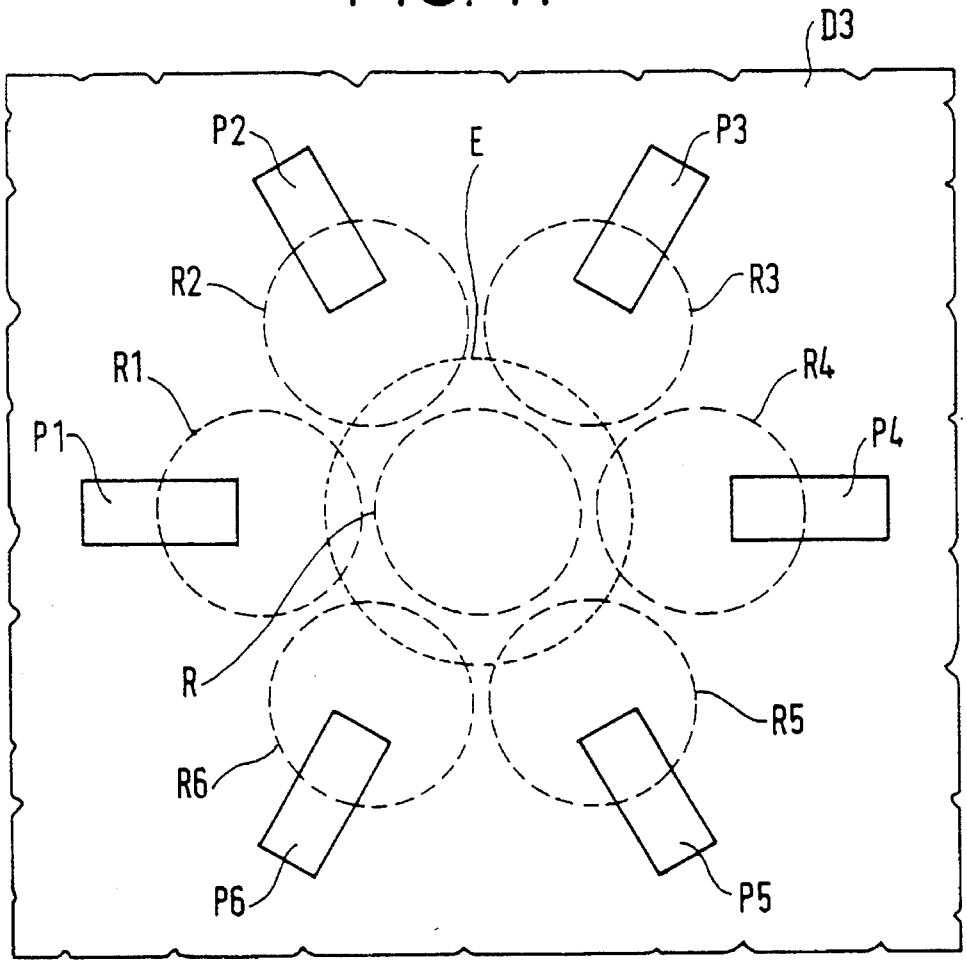
FIG. 11 is a diagrammatic plan view of another example of a printed radiating structure of the invention in which the resonator second element has a multi-element structure, and in which a multi-element resonator third element superposed on the FIG. 5 configuration has the shape and the function of a polarization grid.
Figure 12:
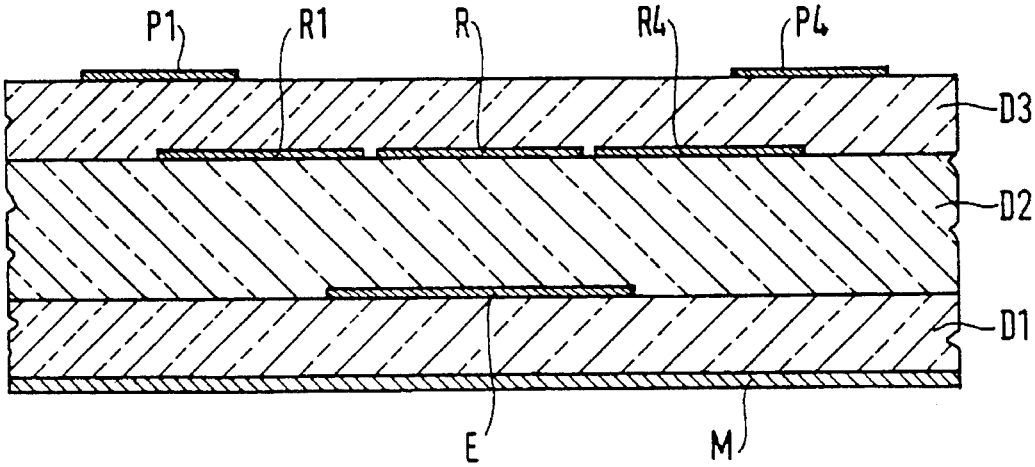
FIG. 12 is a diagrammatic section view through the FIG. 11 example of a printed radiating structure.

FIGS. 11 and 12 are a plan view and a section view respectively of an embodiment of the invention comprising a plurality of levels (D2, D3) each including a multiplicity of radiating elements (R1, . . . , R6; P1, . . . , P6 respectively). The embodiment of FIGS. 11 and 12 includes characteristics to be found in FIGS. 7, 8 and 9, 10. In the example shown here, the elements P1, . . . , P6 are of special shape and disposition, constituting a polarization grid, thereby improving and controlling the polarization transmitted as in FIGS. 7 and 8.

The bottom layer of the radiating structure disposed on a dielectric substrate D1 includes a ground plane (M) and excitation means (not shown) for an exciter patch E; on each of the plurality of substrates stacked thereon (D2, D3) there are multi-element resonators taking up an area on each substrate that increases with the position of the substrate within the structure along the normal direction of radiation from the antenna.

The geometry of the patches and their relative disposition, and also the relative thickness H1/H2/H3 of the dielectric substrates are important parameters for obtaining desired frequency response and varying directivity in application of rules available to the person skilled in the art. Dielectric constant is a parameter that controls coupling and that therefore has an effect on the entire performance of the antenna. The dielectric constants of the various levels may all be identical, or on the contrary, they may be selected to reduce the thickness of dielectric between pairs of patches occupying contiguous levels.

The examples of the preceding figures are based on the multi-element resonators in each level being of simple geometry, and on three levels of plane substrates. The invention can be used on substrates that are curved or shaped, and it can be used with patch geometries and relative dispositions that are complicated to a greater or lesser extent, with the radiating element being designed to satisfy a given mission. The invention may also make use of four or even five or more substrates in building up a radiating structure that has a radiating aperture that is even larger. However, the total thickness of the structure should preferably remain relatively modest in order to satisfy the needs of the intended fields of application, particularly in space.

Comparative measurements have been performed on several of the radiating structures shown in the preceding figures, and the results are summarized in the following table.

TABLE OF MEASUREMENTS PERFORMANCE AT F = 1500 MHz
NB.: The calculations and the measurements shown in this table relate to F = MHz

| | I | II | III | IV |
|---|---|---|---|---|
| Radiating structure | FIG. 1,2 | FIG. 3,4 | FIG. 5,6 | FIG. 11,12 |
| Physical dimensions of the antenna (mm) | | | | |
| Diameter | 120 | 120 | 250 | 310 |
| Thickness | 3 | 11 | 11 | 14 |
| Radio performance | | | | |
| Measured directivity (dB) | 6.5 | 9 | 12.7 | 13.7 |
| On-axis cross-polarization level (dB) | −20 | −20 | −23 | >−30 |
| Level of secondary lobes (dB) | — | — | −20 | −30 |
| Bandwidth (SWR<2)% | 5 | 20 | 25 | 28% (1.15–1.55 GHz) |
| On-axis axial ratio over the passband (dB) | AR < 2 | AR < 2 | 1 < AR < 3 | 0.5 < AR < 2 |

Figure 13:
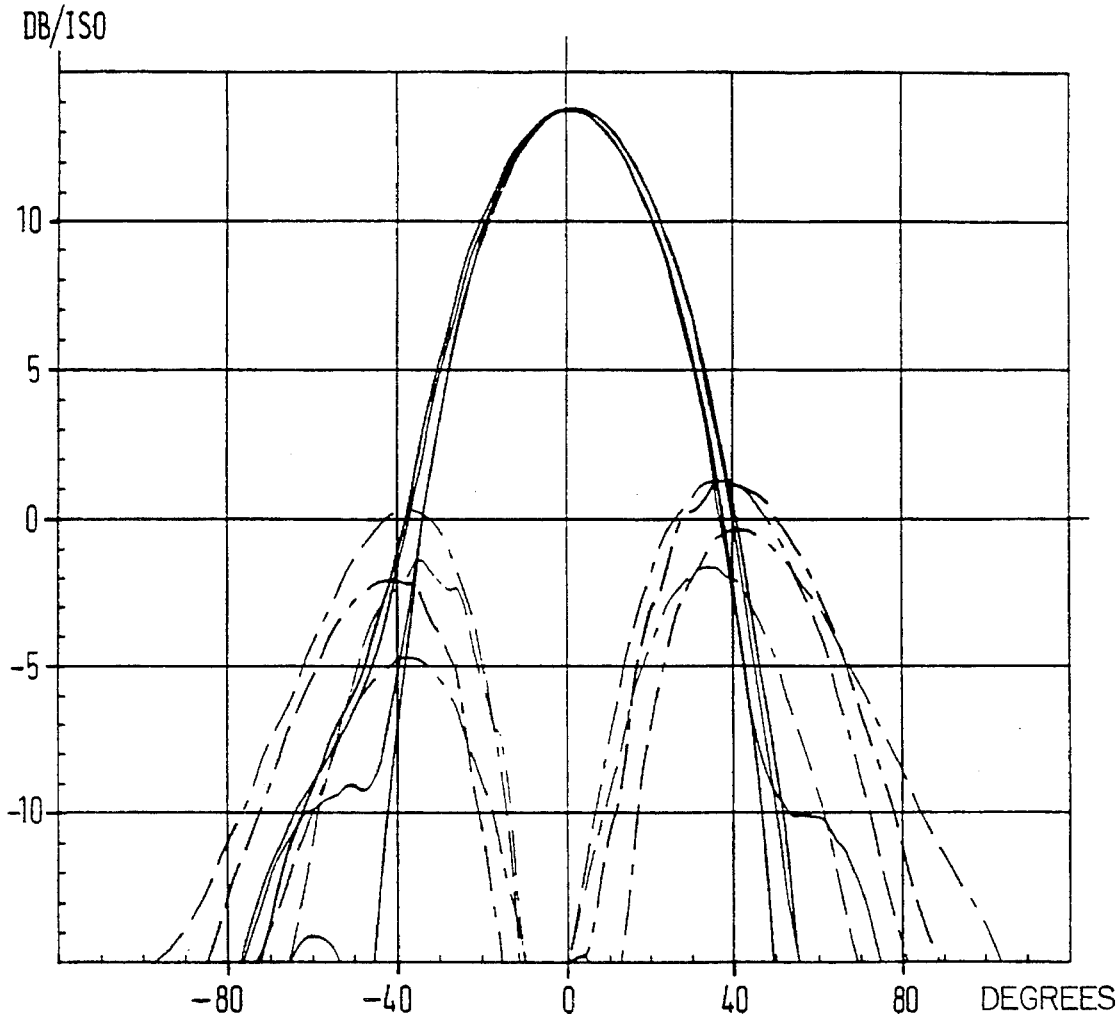
FIG. 13 shows the results of measurements performed on the radiating structure shown in FIGS. 11 and 12.

The results of measurements performed on the structure of FIGS. 11 and 12 are given by the curves plotted in FIG. 13 and they are summarized in the table below. In FIG. 13, the various curves show directivity for different angles of azimuth, i.e. they show measured amplitude relative to an isotropic antenna (in dB/ISO) as a function of elevation angle which is plotted along the abscissa. Cross-polarization levels as a function of elevation are plotted in dashed lines. Secondary lobes are missing from these curves since they are smaller than the scale of these graphs.

VALUES PLOTTED IN FIG. 13

| AMPLITUDE MAXIMUM (dB/ISO) | MERIDIAN (Azimuth) | CIRCULAR POLARIZATION |
|---|---|---|
| 13.7 | 0.00 | LEFT |
| 1.5 | 0.00 | RIGHT |
| 13.8 | 90.00 | LEFT |
| −1.4 | 90.00 | RIGHT |
| 13.8 | 45.00 | LEFT |
| 1.2 | 45.00 | RIGHT |
| 13.7 | 135.00 | LEFT |
| 0.3 | 135.00 | RIGHT |

From these curves and the tables it can be seen that in addition to providing a major increase in the directivity in the antenna of the invention, apodization is effective since the secondary lobes are substantially non-existent. The polarization purity obtained by adding the polarization grid that is excited in sequential rotation by the coupled structure is excellent, as can be seen from the curves in FIG. 13.

Even the bandwidth is improved in this device of the invention by the addition of a level of multi-element resonators. And the axial ratio, a parameter that is important for circular polarization, has also been improved.

In addition to advantages in terms of performance, the radiating structure of the invention provides major advantages in terms of design and implementation of antennas, in particular by eliminating the need for complex distribution structures between the members of a sub-array of radiating elements. In the present invention, the radiating elements are fed solely by electromagnetic coupling, and it is the parameters governing such coupling that determine the feed relationship. The directivity can thus take up values that are intermediate between the discrete values obtained by conventional distribution techniques.

The embodiments shown and the measurements performed are given purely by way of non-limiting examples for the purpose of illustrating the principles of the invention. Other embodiments will easily be devised by the person skilled in the art without thereby going beyond the ambit of the invention.

I claim:

1. A multilayer radiating structure based on microstrip technology for an array antenna, comprising:

radiating patch elements disposed in an upper portion of said structure; and feeding patch means disposed in a lower portion of said structure and coupled for electromagnetic excitation of said radiating patch elements by a distribution of electromagnetic excitation energy between said radiating patch elements, said upper portion comprising at least:

a first dielectric substrate having a surface where a first plurality of radiating patch elements are disposed for forming a first electromagnetic coupling area with said feeding patch means; and a second dielectric substrate having a surface where a second plurality of radiating patch elements are disposed for forming a second electromagnetic coupling area with said first plurality of radiating patch elements, said first dielectric substrate and said second dielectric substrate being stacked on said lower portion with said second electromagnetic coupling area being larger than said first electromagnetic coupling area so as to form said multilayer radiating structure.

2. The radiating structure according to claim 1, wherein the radiating structure is free of special means for distributing excitation electromagnetic energy between said radiating patch elements, said distribution being achieved solely by coupling of magnetic currents generated by each of said radiating patch elements.

3. The radiating structure according to claim 2, wherein the radiating structure is free of special means for coupling excitation electromagnetic energy between said first and second pluralities of radiating patch elements, said excitation being performed solely by coupling of magnetic currents generated by the first plurality of radiating patch elements exciting the second plurality of radiating elements.

4. The radiating structure according to claim 1, wherein said lower portion includes a single feeding patch which is excited by excitation means and which in turn excites said radiating patch elements.

5. The radiating structure according to claim 4, wherein said single feeding patch is fed so as to radiate with a desired polarization.

6. The radiating structure according to claim 5, wherein at least said first plurality of radiating patch elements is disposed on said first dielectric substrate so as to form a radiating structure suitable for reinforcing and refining a polarization of the transmitted radiation.

7. The radiating structure according to claim 5, wherein said polarization is circular, and is obtained by using excitation by sequential rotation in a coupled structure.

8. The radiating structure according to claim 1, wherein the radiating patch elements on said second dielectric substrate are disposed to partially overlie the radiating elements on said first dielectric substrate when seen in projection in a stacking direction of said first and second dielectric substrates.

9. The radiating structure according to claim 1, wherein said second plurality of radiating patch elements constitutes a polarizing grid.

10. The radiating structure according to claim 1, wherein said dielectric substrates are substantially planar.

11. The radiating structure according to claim 1, wherein said dielectric substrates are shaped in three dimensions.

12. An electromagnetic antenna of variable directivity, comprising the multilayer radiating structure according to claim 1.

* * * * *